US006066915A

United States Patent [19]

Pepi

[11] Patent Number: 6,066,915

[45] Date of Patent: May 23, 2000

[54] SPACER ARRANGEMENT IN A FLAT DISPLAY SCREEN

[75] Inventor: Richard Pepi, Montpellier, France

[73] Assignee: Pixtech SA, Rousset, France

[21] Appl. No.: 09/049,333

[22] Filed: Mar. 27, 1998

[30] Foreign Application Priority Data

Mar. 28, 1997 [FR] France ..... 97 04096

[51] Int. Cl.[7] ..... H01J 1/88

[52] U.S. Cl. ..... 313/495; 313/292; 313/288

[58] Field of Search ..... 313/495, 292, 313/456, 250, 253, 257, 286, 288

[56] References Cited

U.S. PATENT DOCUMENTS 5,343,115 8/1994 Anandan et al. ..... 313/292 X 5,600,203 2/1997 Namikawa et al. ..... 313/292 X

*Primary Examiner*—Ashok Patel

*Attorney, Agent, or Firm*—Arthur L. Plevy; Buchanan Ingersoll PC

[57] ABSTRACT

The present invention relates to a flat display screen formed of two parallel plates, defining a space between electrodes, at least a first screen plate including, outside active areas, pads protruding towards a second plate and of a thickness clearly lower than the thickness of the space between electrodes, the pads being distributed by groups of at least three pads to form reception housings for balls of definition of the space between electrodes.

9 Claims, 3 Drawing Sheets

SPACER ARRANGEMENT IN A FLAT DISPLAY SCREEN

BACKGROUND OF THE INVENTION

1. Field of the Invention

The present invention relates to flat display screens. The present invention applies, more specifically, to so-called cathodoluminescence screens, the anode of which supports phosphor elements, separated from one another by insulating areas, and likely to be energized by electron bombardment. This electron bombardment can come from microtips, from layers of low extraction potential, or from a thermo-ionic source.

The present invention more specifically relates to the definition of an internal space, generally in vacuum conditions, wherein flow the electrons emitted by the screen cathode.

To simplify the present description, only color microtip screens will be considered hereafter, but it should be noted that the present invention relates, generally, to the various above-mentioned types of screens and the like.

2. Discussion of the Related Art

FIG. 1 shows the structure of a conventional flat color microtip screen, essentially formed of a cathode 1 with microtips 2 and of a grid 3 provided with holes 4 corresponding to the locations of microtips 2. Cathode 1 is placed facing a cathodoluminescent anode 5, a glass substrate 6 of which forms the screen surface.

The operating principle and an example of embodiment of a microtip screen are described, in particular, in U.S. Pat. No. 4,940,916 of the Commissariat a l'Energie Atomique.

Cathode 1 is organized in columns and is formed, on a glass substrate 10, of cathode conductors organized in meshes from a conductive layer. Microtips 2 are made on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

This device uses the electric field created between cathode 1 and grid 3 to extract electrons from microtips 2. These electrons are then attracted by phosphor elements 7 of anode 5 if these elements are properly biased. In the case of a color screen, anode 5 is provided with alternate strips of phosphor elements 7*r*, 7*g*, 7*b*, each corresponding to a color (Red, Green, Blue). The strips are parallel to the cathode columns and are separated from one another by an insulator 8, generally silicon oxide ($SiO_2$). Phosphor elements 7 are deposited on electrodes 9, formed of corresponding strips of a transparent conductive layer such as indium and tin oxide (ITO).

The assembly of both substrates or plates 6 and 10 respectively supporting anode 5 and cathode 1 is performed by creating a vacuum space 12 of circulation of the electrons emitted by cathode 1. The distance between cathode 1 and anode 5 must be constant so that the screen brightness is regular over its entire surface. Spacers, generally constituted by balls, generally made of glass, of a diameter corresponding to the desired distance between electrodes, are regularly distributed on one of the plates, before the plates are assembled together.

The distance between electrodes, defined by the ball diameter, conventionally is on the order of 200 $\mu$m while the space between two cathode conductors corresponding to different columns is of a given value included between approximately 10 and 100 $\mu$m and the pixels pitch is of a given value included between approximately 50 and 300 $\mu$m.

A problem which then arises is to maintain the balls in their position until the screen is assembled. Indeed, if balls are, during the assembly, in active areas of the screen, they form obstacles to the path of the electrons emitted by microtips 2 towards phosphors 7, which creates shaded areas. To solve this problem, the balls are generally glued to the cathode before assembly.

Patent FR-A-2727242 describes an example of a technique for gluing balls on the cathode. This technique consists of using an application plate, of the screen dimension, provided with circular notches of reception of balls to be glued. The bottom of the notches is pierced to communicate with a suction chamber. Balls placed in bulk in an appropriate container are first sucked in. Then, while maintaining the suction, the balls are put in contact with a plate coated with glue, to deposit a touch of glue on each ball. The cathode-grid plate is then applied on the application plate. Finally, the suction is cut off and the cath-ode-grid plate is moved away from the suction plate. The balls then remain glued on the cathode-grid plate at the locations defined by the notches of the application plate.

Another known gluing technique consists of using, instead of a pierced application plate, a hollow needle to take, spread glue on, and position the balls. This technique is described in U.S. Pat. No. 5,558,732.

A disadvantage of these techniques is that the glue causes a pollution of the surface of the cathode-grid and obliges to perform a vacuum degassing thermal processing.

Another disadvantage is that, as long as the glue is not dry, the balls are still likely to slightly move. Further, during the degassing, a large amount of the glue is evaporated and the balls then risk to move in case of an abrupt motion. Now, the dimensional constraints indicated hereabove lead to the fact that a shifting, even slight, of the ball positions, can have prejudicial consequences by creating shaded areas.

Another disadvantage of these techniques is that they require to position the balls on the cathode plate while the cathode receives the electron emission microtips, which elements are particularly sensitive to degassings. Indeed, it is not possible to glue the balls on the anode since the deposited phosphor elements, on the anode side, would be damaged by the thermal degassing processing.

SUMMARY OF THE INVENTION

The present invention aims at overcoming the disadvantages of known ball positioning techniques.

The present invention specifically aims at providing a solution which does not require any thermal processing step after positioning the balls on one of the screen plates.

The present invention also aims at providing a solution which enables to position balls on the anode side.

The present invention further aims at enabling the use of conventional ball positioning tools.

To achieve these objects, the present invention provides a flat display screen formed of two parallel plates defining a space between electrodes, at least one of the screen plates including, outside active areas, pads of a thickness clearly lower than the thickness of the space between electrodes, the pads being distributed by groups of at least three pads to form reception housings for balls forming spacers.

According to an embodiment of the present invention, each group of pads includes four pads aligned two by two in perpendicular directions.

According to an embodiment of the present invention, the flat screen includes a group of pads at each intersection of two insulating intervals separating neighboring pixels.

According to an embodiment of the present invention, the pads are formed on a silicon oxide layer, constitutive of a screen electrode.

According to an embodiment of the present invention, the pads are deposited by thick layer serigraphy.

According to an embodiment of the present invention, said at least one plate supports a cathode with microtips associated with a grid, the intersection of a cathode conductor with a grid conductor defining a screen pixel.

According to an embodiment of the present invention, said at least one plate is an anode plate.

According to an embodiment of the present invention, openings of reception of phosphor elements are made in an insulating layer formed on anode conductors, the openings being, at least in one direction, of a size corresponding to a first dimension of a screen pixel.

According to an embodiment of the present invention, the anode comprises three sets of alternate strips of conductors, the insulating layer added on the conductors being opened by sections above each strip, the width of three associated parallel strips defining a second dimension of a screen pixel.

The foregoing objects, features and advantages of the present invention, will be discussed in detail in the following non-limiting description of specific embodiments made in connection with the accompanying drawings.

DETAILED DESCRIPTION

Figure 1:
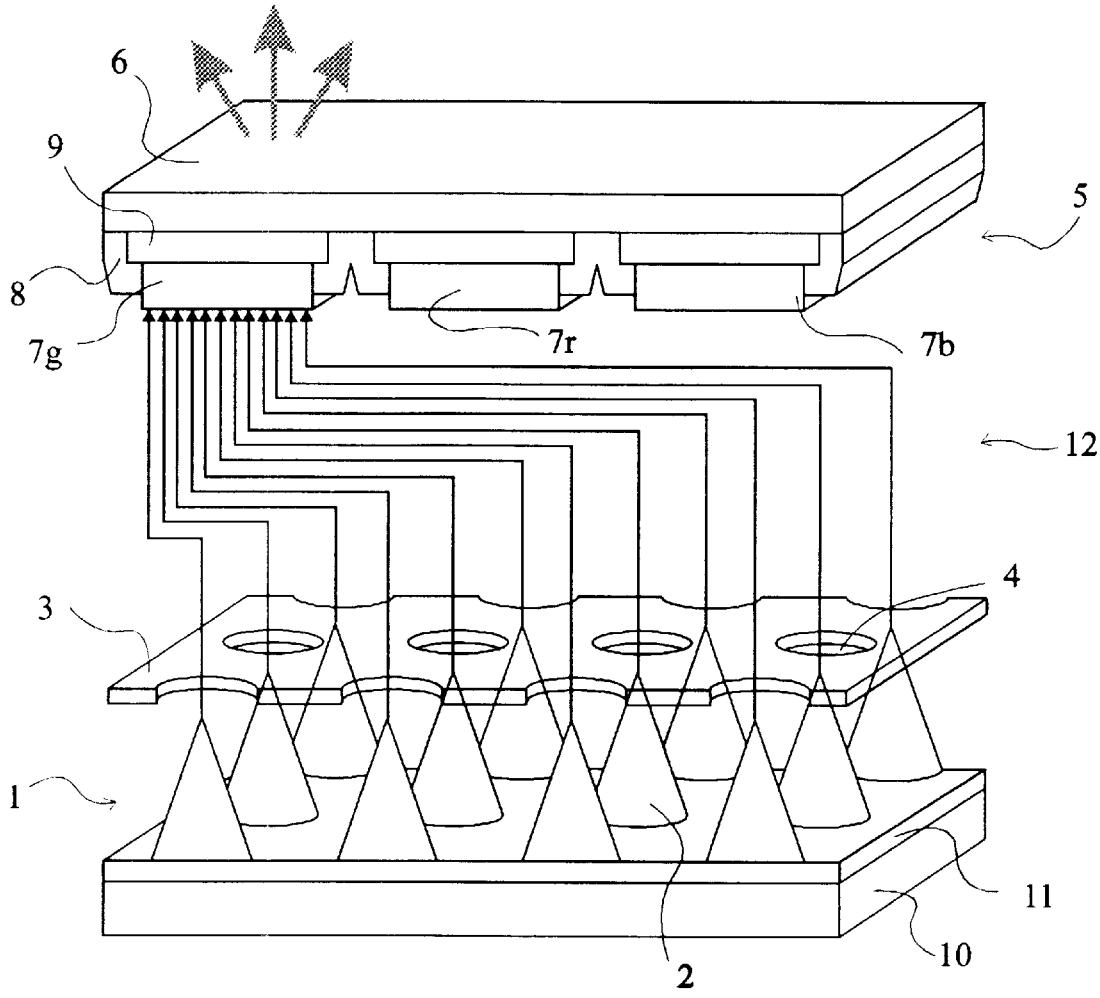
FIG. 1, previously described, is meant to show the state of the art and the problem to solve.

For clarity, the drawings are not to scale and only those elements which are necessary to the understanding of the present invention have been shown in the drawings and will be described hereafter.

The present invention provides to form, on the internal surface of the screen where balls forming spacers are to be deposited, pads for temporarily maintaining the balls until the screen is sealed. According to the present invention, these pads are disposed by groups defining, each, a ball reception housing.

Figure 2A:
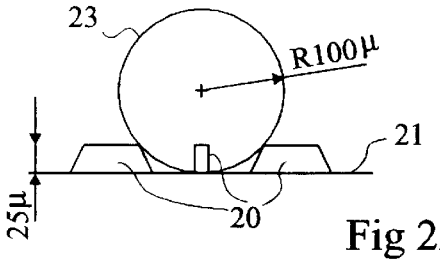
FIGS. 2A and 2B schematically illustrate, respectively in side view and in cross-sectional view, an embodiment of the present invention.
Figure 2B:
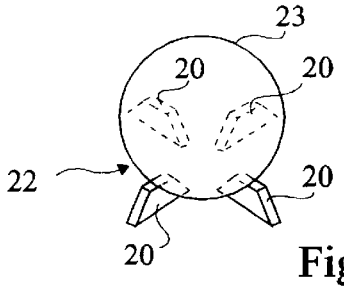

FIGS. 2A and 2B show an embodiment of pads or blocks 20 for temporarily maintaining spacers according to the present invention.

Pads 20 are formed directly by serigraphy of silicon oxide, or another material, preferably insulating, which can be deposited by serigraphy in a thick layer, on an anode or cathode plate. Pads 20 are distributed by groups of at least three pads arranged to define a housing 22 for temporarily maintaining a ball 23 forming a spacer. Preferably, each group is formed of four pads 20 aligned two by two, in two perpendicular directions corresponding, preferably, to the directions of the screen lines and columns. Pads 20 are arranged above the intervals separating the screen pixels, and thus outside the active areas of the screen.

The spacing between two aligned pads 20 of a same housing 22 is chosen to enable the positioning of a ball 23, while taking the positioning tolerances (generally +/−10 $\mu$m) imposed by the ball positioning tool into account.

The height of pads 20 is chosen according to the diameter of balls 23, preferably between 10 and 25% of the ball diameter. For example, for balls of a diameter on the order of 200 $\mu$m, pads of a height on the order of 25 $\mu$m will be provided.

Each housing 22 is meant for receiving, without gluing, a ball 23 and for maintaining it in place as long as the second plate constitutive of the screen has not been mounted on the first plate.

An advantage of the present invention is that the use of pads 20 avoids the use of vacuum degassing thermal processings to suppress the pollution brought in by the glue layers during the conventional ball deposition.

Another advantage of the present invention is that the use of serigraphied pads enables to obtain an excellent accuracy in the positions of housings 22 on the internal surface of the involved plate. According to an alternative of the present invention, the pads may be etched in a thick layer previously uniformly deposited.

Figure 3:
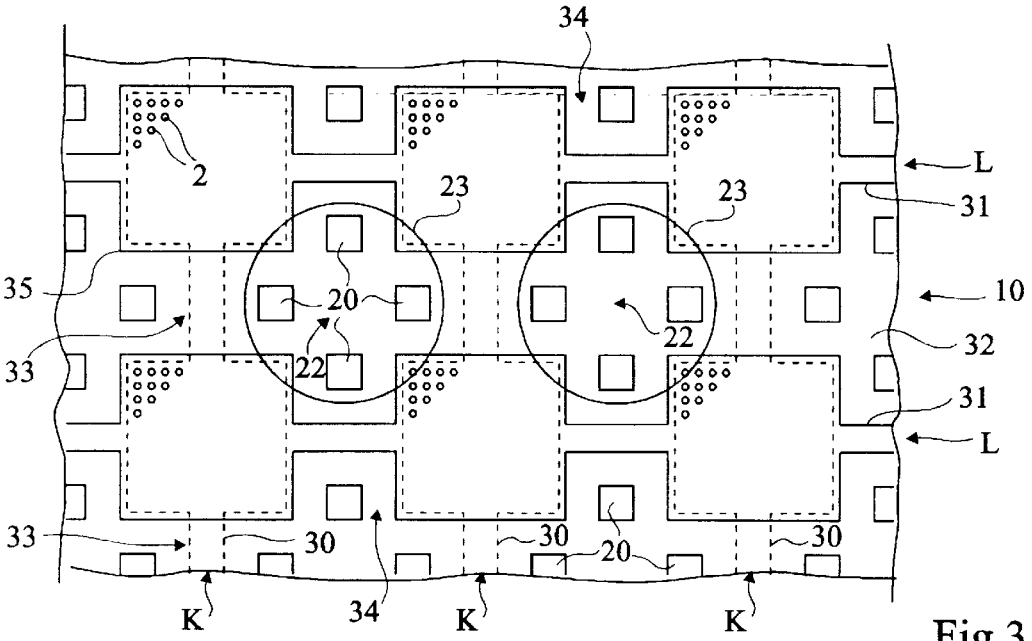
FIG. 3 shows an example of a flat display screen cathode provided with means for temporarily maintaining spacers according to the present invention.

FIG. 3 is a partial view of a flat display screen cathode provided with pads according to an embodiment of the present invention.

Conventionally, the cathode is organized in columns K and is formed, on a substrate 10, for example, made of glass, of conductors 30 organized in meshes from a conductive layer (in dotted lines in FIG. 3). Microtips 2 are made on a resistive layer (not shown) deposited, for example, on conductors 30 and are arranged within the meshes defined by these conductors 30. The meshing of the cathode conductors has not been shown for clarity.

The cathode is associated with a grid organized in lines L and formed of conductors 31 formed in a semiconductive layer deposited on an insulating layer 32, for example, made of $SiO_2$, mounted on the cathode conductors. Conductors 31 are thus separated from one another by insulating intervals 33. Similarly, conductors 30 are separated from one another by insulating intervals 34. Conductors 31 and layer 32 are opened at the locations of microtips 2. Pixels 35 of the screen are defined by the intersection of a line L with a column K. For clarity, only a few microtips 2 have been shown per pixel 35. It should however be noted that each pixel includes several thousands of microtips.

According to the present invention, when balls are to be deposited on the cathode side, pads 20 are formed on insulating layer 32 in intervals 33 which separate grid conductors 31 and in intervals 34 which separate cathode conductors 30. A group of four pads 20, defining a housing 22 of reception of a ball 23, includes two pads aligned between two conductors 30 and two pads aligned between two conductors 31.

The number of pad groups made between pixels 35 depends on the desired ball density in the space between electrodes. In the example shown, a group of pads 20 is provided between each pixel, that is, pads 20 are provided in each interval 33 and 34. It should however be noted that, even if pads have been made between each pixel 35, it is subsequently possible not to deposit a ball in each housing 22 according to the desired spacer density.

According to the present invention, it is preferred to make pads 20 on the anode side, and not on the cathode side. A positioning of balls 3 on the anode side is now possible since, according to the present invention, this positioning does not require any additional thermal processing with respect to the method of implementation of the anode and, especially, no thermal degassing of a ball fixing glue.

A first advantage of positioning the balls on the anode side is that this does not add any step to the method of implementation of the cathode which is already, by the presence of microtips, a very delicate method to implement. A second advantage is that pads 20 can then be deposited by using the same technique (serigraphy) as that which is generally used to implement the anode.

Figure 4:
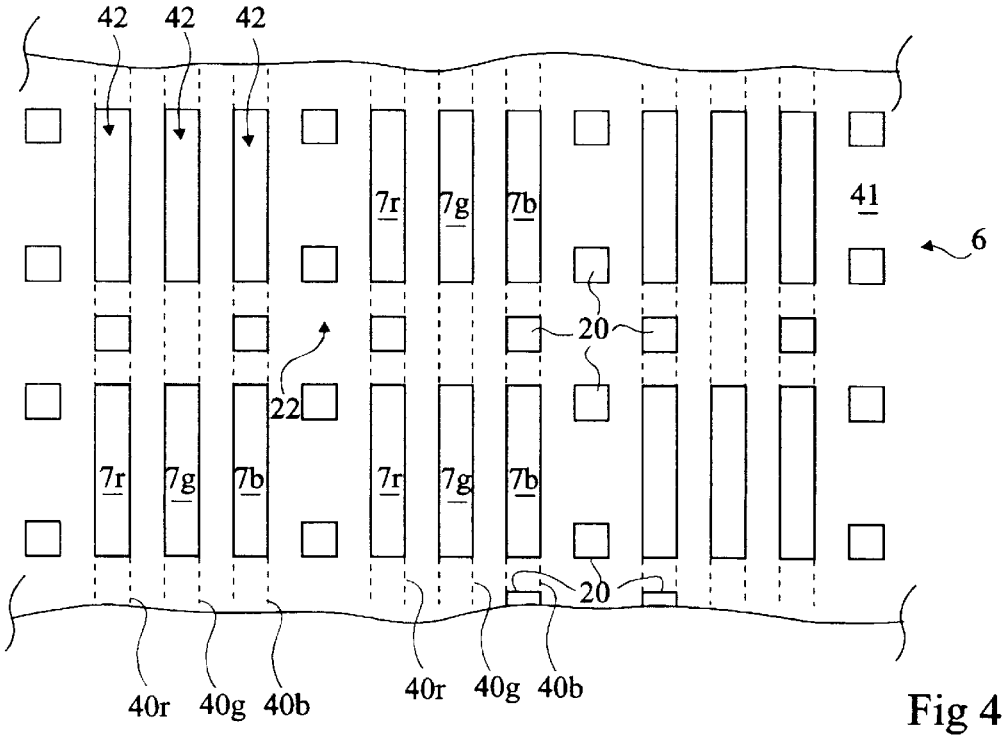
FIG. 4 shows, in bottom view, an embodiment of a flat display screen cathode provided with means for temporarily maintaining spacers according to the present invention.

FIG. 4 partially shows, in bottom view, a color anode provided with pads for temporarily maintaining spacers according to an embodiment of the present invention.

The anode is, conventionally, provided with conductors strips 40 made on a glass substrate 6, separated from one another by an insulator 41, generally $SiO_2$, and over which phosphor elements 7 of the different colors are deposited. Strips 40 are interconnected by color of phosphor element, that is, they form three combs of alternate strips of conductors 40*r*, 40*g*, 40*b*, each corresponding to a color.

According to the present invention, phosphor elements 7*r*, 7*g*, 7*b* are no longer deposited in uninterrupted strips, but are deposited according to the pattern of the screen pixels. In other words, insulating layer 41 is opened, above conductors 40, by sections 42, the length of a section 42 corresponding to a dimension of a screen pixel. The other dimension of a pixel is defined by the width of a group of three sections 42 each corresponding to a color.

According to the present invention, pads 20 are deposited by serigraphy in insulating layer 41, preferably between each screen pixel. Pads 20 are arranged, in a first direction, between two groups of three conductors 40, and thus between two neighboring pixels in this direction and, in a second direction, perpendicularly to conductors 40, between two neighboring pixels.

An advantage of the present invention is that it is perfectly compatible with conventional ball positioning tools.

Figure 5A:
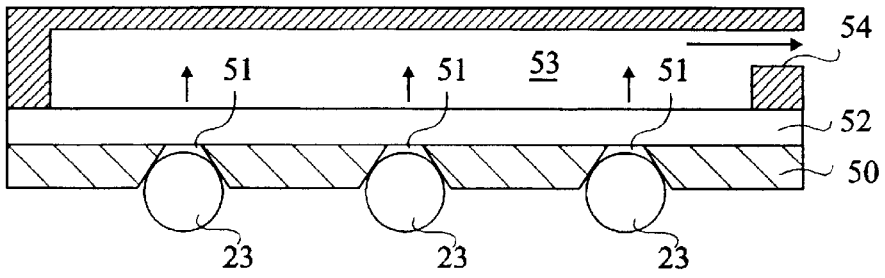
FIGS. 5A to 5C schematically illustrate an example of spacer laying according to an embodiment of the present invention, by means of an aspiration system.
Figure 5B:
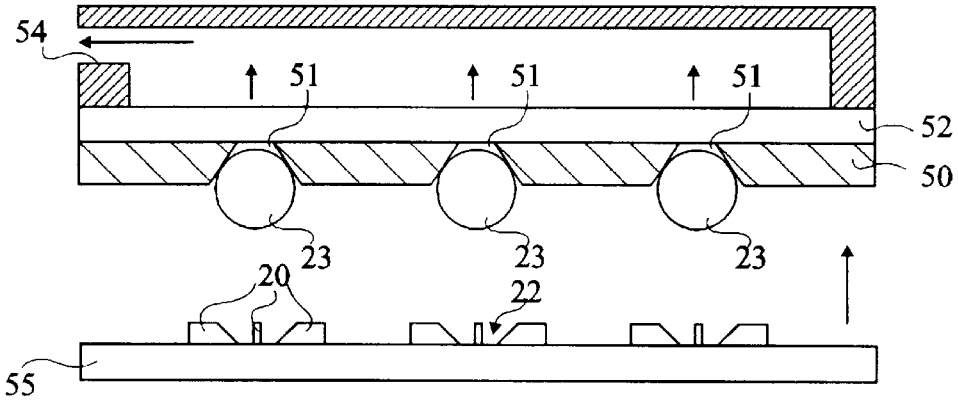
Figure 5C:
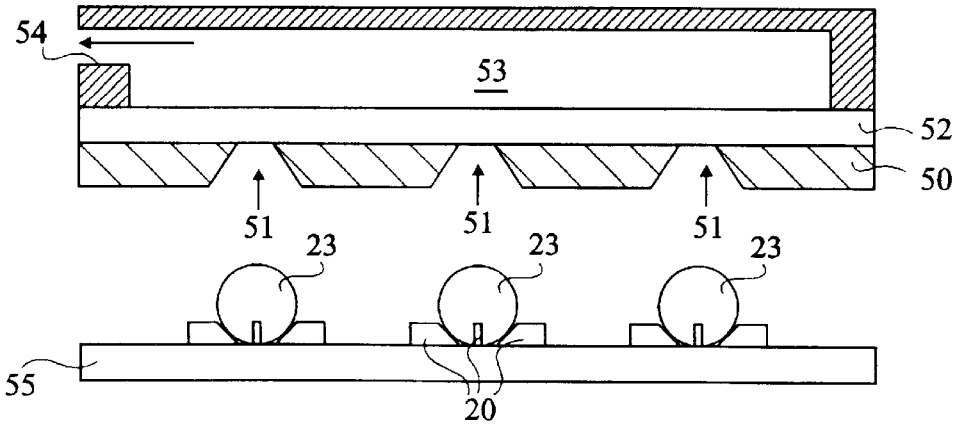

FIGS. 5A to 5C very schematically illustrate the use of a ball positioning tool such as a collective positioning tool described in patent FR-A-2727242.

First (FIG. 5A), balls 23 are sucked in from a ball container (not shown), by means of a plate applicator formed of a plate 50 provided with notches 51 at the desired locations for balls 23. Each notch 51 is opened to communicate, via a filter 52 (for example, a porous paper), with a suction chamber 53 having an opening 54 connected to a pump (not shown). The distribution of notches 51 in plate 50 corresponds to the desired locations of balls 23, with a pitch corresponding to the pitch of the screen pixels or to a multiple of the pixel pitch.

Then (FIG. 5B), plate 50 is positioned above a screen plate 55 (anode or cathode) on which pads 20 such as previously described have been made. Plate 55 is maintained in a substantially horizontal position, with its internal surface directed upwards.

Application plate 50 is lowered (or plate 55 is raised) until balls 23 are in contact with the surface of plate 55.

Finally, the suction is cut off and the application layer is lifted back (or plate 55 is lowered). Balls 23 are then (FIG. 5C) each in a housing 22.

There only remains to perform the assembly of the screen plate, balls 23 being maintained in housings 22. It will of course be seen to it that the plate on which the balls are deposited is maintained horizontal as long as the other plate has not been mounted on the free ball surfaces.

Of course, the present invention is likely to have various alterations, modifications, and improvements which will readily occur to those skilled in the art. In particular, the present invention also applies to a monochrome screen. In this case, if the pads are made on the anode side, the screen pixels are also defined on the anode side by openings of the size of a pixel in a silicon oxide insulating layer. Finally, pads 20 may be made on both screen plates.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. A flat display screen formed of two parallel plates (6, 10; 55) defining a space (12) between electrodes, wherein at least one of the screen plates includes, outside active areas (35), pads (20) of a thickness clearly lower than the thickness of the space between electrodes, the pads being distributed by groups of at least three pads to form reception housings (22) for balls (23) forming spacers.

2. The flat screen of claim 1, wherein each group of pads (20) includes four pads aligned two by two in perpendicular directions.

3. The flat screen of claim 1, including a group of pads (20) at each intersection of two insulating intervals (33, 34) separating neighboring pixels (35).

4. The flat screen of claim 1, wherein the pads (20) are formed on a silicon oxide layer (32, 41), constitutive of a screen electrode.

5. The flat screen of claim 4, wherein the pads (20) are deposited by thick layer serigraphy.

6. The flat screen of claim 1, wherein said at least one plate (10) supports a cathode (1) with microtips (2) associated with a grid (3), the intersection of a cathode conductor (30) with a grid conductor (31) defining a screen pixel (35).

7. The flat screen of claim 1, wherein said at least one plate (6) is an anode plate (5).

8. The flat screen of claim 7, wherein openings (42) of reception of phosphor elements (7) are made in an insulating layer (41) formed on anode conductors (40), the openings being, at least in one direction, of a size corresponding to a first dimension of a screen pixel.

9. The flat screen of claim 7, in which the anode (5) comprises three sets of alternate strips of conductors (40), wherein the insulating layer (41) added on the conductors is opened by sections (42) above each strip, the width of three associated parallel strips defining a second dimension of a screen pixel.

* * * * *